US007224917B2

(12) United States Patent
Julien et al.

(10) Patent No.: US 7,224,917 B2
(45) Date of Patent: May 29, 2007

(54) METHOD AND SYSTEM FOR REDUCING TONER ABUSE IN DEVELOPMENT SYSTEMS OF ELECTROPHOTOGRAPHIC SYSTEMS

(75) Inventors: Paul C. Julien, Webster, NY (US); Daniel M. Bray, Rochester, NY (US); Aaron M. Burry, West Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 305 days.

(21) Appl. No.: 11/090,727

(22) Filed: Mar. 25, 2005

(65) Prior Publication Data

US 2006/0216049 A1 Sep. 28, 2006

(51) Int. Cl.
*G03G 15/08* (2006.01)

(52) U.S. Cl. ..... 399/53; 399/291

(58) Field of Classification Search ..... 399/38, 399/53, 252, 265, 266, 290, 291
See application file for complete search history.

(56) References Cited

U.S. PATENT DOCUMENTS 5,063,875 A 11/1991 Folkins et al.
5,324,884 A 6/1994 Honda et al.
5,495,322 A 2/1996 Wada et al.
5,875,379 A 2/1999 Machida et al.
6,101,357 A 8/2000 Wayman
6,154,626 A 11/2000 Litman et al.
6,512,909 B2 1/2003 Ozawa et al.
6,665,510 B1 12/2003 Hirsch
6,907,216 B2 * 6/2005 Nishimura ..... 399/282
6,917,780 B2 * 7/2005 Ozawa et al. ..... 399/282

* cited by examiner

*Primary Examiner*—Hoan Tran
(74) *Attorney, Agent, or Firm*—Maginot, Moore & Beck

(57) ABSTRACT

An improved development system for an electrophotographic system includes a reload defect detector for generating a signal corresponding to a potential for reload defect detected in an image to be developed by an electrophotographic system; and a magnetic roll speed selector for selecting a rotational speed for a magnetic roll in a development system of the electrophotographic system, the selected rotational speed corresponding to the generated reload defect potential signal. The speed of the magnetic roll is selected to be a lower speed in response to the potential for reload defect being relatively low. The slower rotation of the magnetic roll prolongs the life of the developer and extends the operational life of the development system before corrective action is needed.

20 Claims, 6 Drawing Sheets

METHOD AND SYSTEM FOR REDUCING TONER ABUSE IN DEVELOPMENT SYSTEMS OF ELECTROPHOTOGRAPHIC SYSTEMS

TECHNICAL FIELD

The present invention relates generally to electrophotographic printing machines, and more particularly, to development systems in electrophotgraphic printing machines.

BACKGROUND

Generally, the process of electrophotographic printing includes charging a photoconductive member to a substantially uniform potential to sensitize its surface. The charged portion of the photoconductive surface is exposed to a light image from a scanning laser beam or an LED source that corresponds to an original document being reproduced. The effect of the light on the charged surface produces an electrostatic latent image on the photoconductive surface. After the electrostatic latent image is recorded on the photoconductive surface, the latent image is developed. Two-component and single-component developer materials are commonly used for development. A typical two-component developer comprises a mixture of magnetic carrier granules and toner particles that adhere triboelectrically to the latent image. A single-component developer material is typically comprised of toner particles without carrier particles. Toner particles are attracted to the latent image, forming a toner powder image on the latent image of the photoconductive surface. The toner powder image is subsequently transferred to a copy sheet. Finally, the toner powder image is heated to permanently fuse it to the copy sheet to form the hard copy image.

One common type of development system uses one or more donor rolls to convey toner to the latent image on the photoconductive member. A donor roll is loaded with toner either from a two-component mixture of toner and carrier particles or from a single-component supply of toner. The toner is charged either from its triboelectric interaction with carrier beads or from suitable charging devices such as frictional or biased blades or from other charging devices. As the donor roll rotates it carries toner from the loading zone to the latent image on the photoconductive member. There, suitable electric fields can be applied with a combination of DC and AC biases to the donor roll to cause the toner to develop to the latent image. Additional electrodes, such as those used in the Hybrid Scavengeless Development (HSD) technology may also be employed to excite the toner into a cloud from which it can be harvested more easily by the latent image. The process of conveying toner, sometimes called developer, to the latent image on the photoreceptor is known as "development."

A problem with donor roll developer systems is a defect known as ghosting or reload, which appears as a lightened ghost image of a previously developed image in a halftone or solid on a print. Reload defect occurs when insufficient toner has been loaded onto the donor roll within one revolution of the donor roll after an image has been printed. The donor roll retains the memory of the image, and a ghost image shows up, if another image is printed at that time.

One way of improving the ability of the toner supply to provide an adequate amount of toner to reduce or prevent ghost images is to increase the peripheral speed of the magnetic brush or roll that transfers toner from the supply reservoir to the donor roll. As the relative difference in the speed of the magnetic and donor rolls increases so do the collisions of the carrier or toner granules as well. The toner particles also impinge on the blade mounted proximate to the magnetic brush to regulate, or trim, the height of the magnetic brush so that a controlled amount of toner is transported to the developer roll. The collisions of the toner with the carrier and the trim blade tend to smooth the surface of the toner particles and cause the particles to exhibit increased adhesion. This increased adhesion causes the toner particles to adhere more strongly to the donor roll, and less toner is transferred to the photoreceptor to develop the latent image at a given development voltage. The reduction in the developability of the toner particles is sometimes known as toner abuse.

The stability of the toner may be monitored by maintaining a historical log of the development voltage necessary to provide adequate toner density. As the development system loses the ability to develop toner on the latent image, the absolute value of the development voltage is increased. As the development voltage absolute value approaches the maximum of the development system, corrective action is required to restore the ability of the development system to develop the toner.

What is needed is a way of reducing the abuse of the toner without causing the reload or ghosting defect.

SUMMARY

The above-described limitations of development systems in known electrophotographic machines are addressed by a system and method that controls the speed of the magnetic roll in correspondence with image content. An improved development system for an electrophotographic system comprises a reload defect detector for generating a signal corresponding to a potential for reload defect detected in an image to be developed by an electrophotographic system; and a magnetic roll speed selector for selecting a rotational speed for a magnetic roll in a development system of the electrophotographic system, the selected rotational speed corresponding to the generated reload defect potential signal. The rotational speed selected may be a slower speed that preserves toner life and a higher speed that reduces the likelihood that a reload defect will appear in the developed image. The slower speed is selected in response to the potential for reload defect being low and the higher speed is selected in response to the potential for reload defect being higher. Because the number of pages requiring the higher magnetic roll speed to compensate for reload defect is relatively low in the typical output of an electrophotographic system, the development system is able to operate longer before the maximum development voltage is reached and corrective action is required.

The reload defect detector may generate different types of signals indicative of the reload defect potential of an analyzed image. For example, the reload defect detector may generate an analog signal indicative of a reload defect potential in the image to be developed by the electrophotographic system. The reload defect detector may alternatively generate a digital signal indicative of a reload defect potential in the image to be developed by the electrophotographic system. The digital signal may be a binary signal or a digital value that is indicative of a probability for the detected reload defect. When the signal is a binary signal it indicates that a reload defect is likely or not. When the signal is a digital value, the signal may be a multi-bit digital word that indicates a probability of a reload defect in an image.

The magnetic roll speed selector of the improved development system may generate a current signal or a voltage signal that corresponds to a rotational speed magnitude. For example, the magnetic roll speed selector may generate a current that is supplied to motor drive for the magnetic roll and the greater the magnitude of the current the faster the magnetic roll is rotated. The magnetic roll speed selector of the improved development system may alternatively generate a digital signal that corresponds to a rotational speed magnitude. For example, the magnetic roll speed selector may generate a binary signal that selects whether the magnetic roll is driven at a high speed or a slow speed. In another alternative, the magnetic roll speed selector generates a digital value that corresponds to a magnetic roll speed in a predetermined range of magnetic roll speed.

The magnetic roll speed selector may also include an input for a development voltage, a comparator for comparing the development voltage and a reference signal so the magnetic roll speed selector generates a continuous high speed signal in response to the development voltage being equal to or greater than the reference signal. In effect, once the development voltage reaches or exceeds its maximum value, the magnetic speed selector is disabled from selecting the slower speed. This feature is useful because once the maximum development voltage is required to develop toner, the system requires corrective action and maximum magnetic roll speed is necessary more frequently for avoiding reload defects.

An improved method for operating a development system in an electrophotographic system comprises generating a signal corresponding to a potential for reload defect detected in an image to be developed by an electrophotographic system, and selecting a rotational speed for a magnetic roll in a development system of the electrophotographic system. The rotational speed selected corresponds to the reload defect potential signal. The potential reload defect signal generated may be an analog signal indicative of a reload defect potential in the image to be developed or a digital signal indicative of a reload defect potential in the image. A digital potential reload defect signal generation may be a binary signal or, alternatively, a digital value that is indicative of a probability for the detected reload defect.

The method for controlling the speed of a magnetic roll may include generating a signal corresponding to a rotational speed magnitude. The generated signal may be a binary signal corresponding to a predetermined rotational speed magnitude or, alternatively, a digital value that corresponds to a magnetic roll speed in a predetermined range of magnetic roll speed. This feature enables the speed of the magnetic roll to be correlated to the potential for reload defect determined by the reload defect detector.

The method may further include receiving a signal corresponding to a development voltage, comparing the development voltage signal and a reference signal, and generating a continuous high speed signal in response to the development voltage being equal to or greater than the reference signal. This aspect disables the slower magnetic roll speed from being selected because once the maximum development voltage is required to develop toner, maximum magnetic roll speed is necessary more frequently for avoiding reload defects.

The above described features and advantages, as well as others, will become more readily apparent to those of ordinary skill in the art by reference to the following detailed description and accompanying drawings.

BRIEF DESCRIPTION OF THE DRAWINGS

By way of example, an embodiment of the invention will be described with reference to the accompanying drawings, in which.

DETAILED DESCRIPTION

Figure 1:
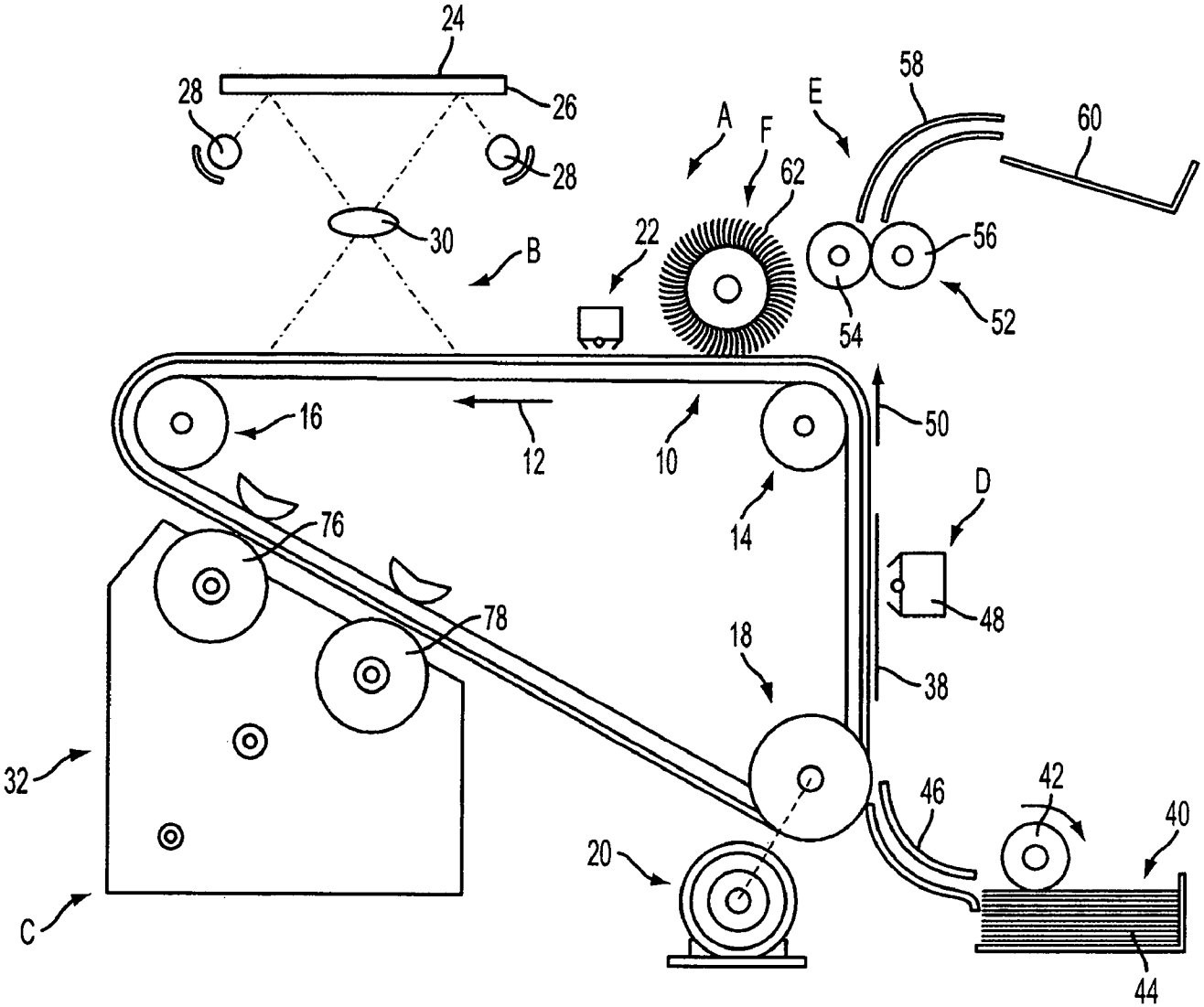
FIG. 1 is a schematic elevational view depicting an illustrative electrophotographic printing machine incorporating the development apparatus of the present invention therein.

In the drawings, like reference numerals have been used throughout to designate identical elements. FIG. 1 schematically depicts the various components of an illustrative electrophotographic printing machine incorporating the development apparatus of the present invention. This development apparatus is also well suited for use in a wide variety of electrostatographic printing machines and for use in ionographic printing machines. Because the various processing stations employed in the FIG. 1 printing machine are well known, they are shown schematically and their operation is described only briefly.

The printing machine shown in FIG. 1 employs a photoconductive belt 10 of any suitable type, which moves in the direction of arrow 12 to advance successive portions of the photoconductive surface of the belt through the various stations disposed about the path of movement thereof. As shown, belt 10 is entrained about rollers 14 and 16 which are mounted to be freely rotatable and drive roller 18 which is rotated by a motor 20 to advance the belt in the direction of the arrow 12. Initially, a portion of belt 10 passes through a charging station A. At charging station A, a corona generation device, indicated generally by the reference numeral 22, charges a portion of the photoconductive surface of belt 10 to a relatively high, substantially uniform potential. Next, the charged portion of the photoconductive surface is advanced through an exposure station B. At exposure station B, an original document 24 is positioned face down upon a transparent platen 26. Lamps 28 illuminate the document 24 and the light reflected from the document is transmitted through lens 30 to form a light image on the charged portion of the photoconductive surface. The charge on the photoconductive surface is selectively dissipated, leaving an electrostatic latent image on the photoconductive surface which corresponds to the original document 24 disposed upon transparent platen 26. The belt 10 then advances the electrostatic latent image to a development station C.

At development station C, a development apparatus indicated generally by the reference numeral 32, transports toner particles to develop the electrostatic latent image recorded on the photoconductive surface. The development apparatus 32 is described hereinafter in greater detail with reference to FIG. 2. Toner particles are transferred from the development apparatus to the latent image on the belt, forming a toner powder image on the belt, which is advanced to transfer station D.

At transfer station D, a sheet of support material 38 is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D. Transfer station D includes a corona generating device 48 which sprays ions onto the back side of sheet 38. This attracts the toner powder image from the photoconductive surface to sheet 38. After transfer, the sheet continues to move in the direction of arrow 50 into a conveyor (not shown) which advances the sheet to fusing station E.

Fusing station E includes a fusing assembly, indicated generally by the reference numeral 52, which permanently affixes the transferred powder image to sheet 38. Preferably, fuser assembly 52 includes a heated fuser roller 54 and back-up roller 56. Sheet 38 passes between fuser roller 54 and back-up roller 56 with the toner powder image contacting fuser roller 54. In this way, the toner powder image is permanently affixed to sheet 38.

After fusing, chute 58 guides the advancing sheet to catch tray 60 for subsequent removal from the printing machine by the operator. Invariably, after the sheet of support material is separated from the photoconductive surface of belt 10, some residual toner particles remain adhering thereto. These residual particles are removed from the photoconductive surface at cleaning station F.

Cleaning station F includes a pre-clean corona generating device (not shown) and a rotatably mounted fibrous brush 62 in contact with the photoconductive surface of belt 10. The pre-clean corona generating device neutralizes the charge attracting the particles to the photoconductive surface. These particles are cleaned from the photoconductive surface by the rotation of brush 62 as it contacts the photoconductive surface. Subsequent to cleaning, a discharge lamp (not shown) floods the photoconductive surface with light to dissipate any residual charge remaining thereon prior to the charging thereof for the next successive imaging cycle.

Figure 2:
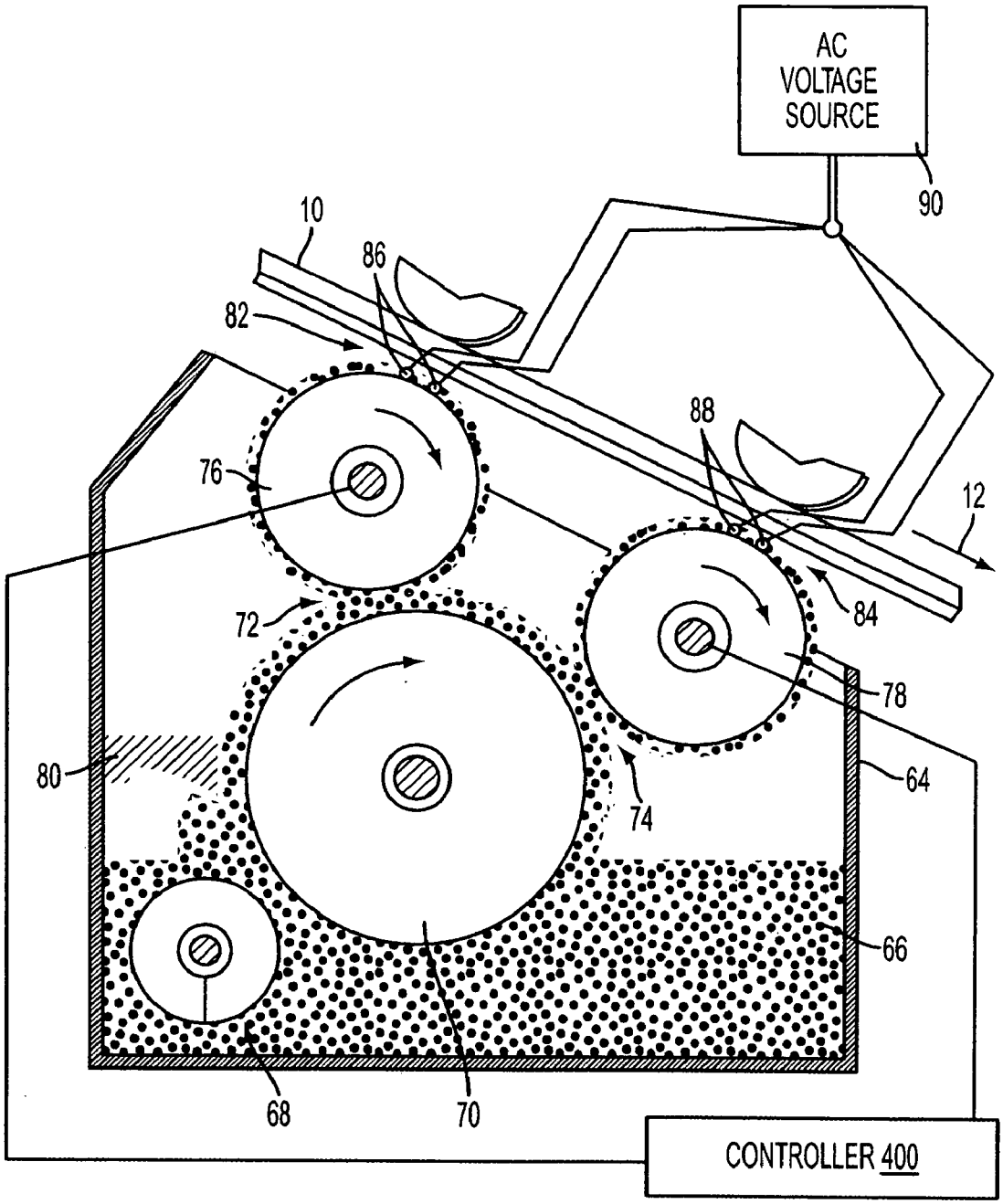
FIG. 2 is a schematic elevational view showing the development apparatus of the FIG. 1 printing machine in greater detail.

Referring now to FIG. 2, there are shown the details of the development apparatus 32. The apparatus comprises a reservoir 64 containing developer material 66. The developer material 66 shown in FIG. 2 is two component toner, that is, it is toner comprised of carrier granules and toner particles. The reservoir includes augers, indicated at 68, which are rotatably-mounted in the reservoir chamber. The augers 68 serve to transport and to agitate the material within the reservoir. This activity encourages the toner particles to adhere triboelectrically to the carrier granules. A magnetic brush roll 70 transports developer material from the reservoir to the loading nips 72, 74 of two donor rolls 76, 78. Magnetic brush rolls are well known, so the construction of roll 70 need not be described in great detail. Briefly the roll comprises a rotatable tubular housing within which is located a stationary magnetic cylinder having a plurality of magnetic poles impressed around its surface. The carrier granules of the developer material are magnetic. As the tubular housing of the roll 70 rotates, the granules (with toner particles adhering triboelectrically thereto) are attracted to the roll 70 and are conveyed to the donor roll loading nips 72, 74. A metering blade 80 removes excess developer material from the magnetic brush roll and ensures an even depth of coverage with developer material before arrival at the first donor roll loading nip 72. At each of the donor roll loading nips 72, 74, toner particles are transferred from the magnetic brush roll 70 to the respective donor roll 76, 78.

Each donor roll transports the toner to a respective development zone 82, 84 through which the photoconductive belt 10 passes. Transfer of toner from the magnetic brush roll 70 to the donor rolls 76, 78 can be encouraged by, for example, the application of a suitable D.C. electrical bias to the magnetic brush and/or donor rolls. The D.C. bias (for example, approximately 100V applied to the magnetic roll) establishes an electrostatic field between the donor roll and magnetic brush rolls, which causes toner particles to be attracted to the donor roll from the carrier granules on the magnetic roll.

The carrier granules and any toner particles that remain on the magnetic brush roll 70 are returned to the reservoir 64 as the magnetic brush continues to rotate. The relative amounts of toner transferred from the magnetic roll 70 to the donor rolls 76, 78 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At each of the development zones 82, 84, toner is transferred from the respective donor roll 76, 78 to the latent image on the belt 10 to form a toner powder image on the latter. Various methods of achieving an adequate transfer of toner from a donor roll to a photoconductive surface are known and any of those may be employed at the development zones 82, 84.

In FIG. 2, each of the development zones 82, 84 is shown as having electrode wires disposed in the space between each donor roll 76, 78 and belt 10. FIG. 2 shows, for each donor roll 76, 78, a respective pair of electrode wires 86, 88 extending in a direction substantially parallel to the longitudinal axis of the donor roll. The electrode wires are made from thin (e.g., 50 to 100 micron diameter) wires which are closely spaced from the respective donor roll when there is no voltage difference between the wires and the roll. The distance between each wire and the respective donor roll is within the range from about 10 microns to about 40 microns (typically approximately 25 microns). The wires are self-spaced from the donor rolls by the thickness of the toner on the donor rolls. To this end, the extremities of the wires are supported by the tops of end bearing blocks that also support the donor rolls for rotation. The wire extremities are attached so that they are-slightly above a tangent to the surface of the donor roll structure. An alternating electrical bias is applied to the electrode wires by an AC voltage source 90.

The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10. The magnitude of the AC voltage is on the order of 200 to 500 volts peak to peak at a frequency ranging from about 3 kHz to about 15 kHz. A DC bias supply (not shown) is applied to each donor roll 76, 78 to establish electrostatic fields between the belt 10 and donor rolls for attracting the detached toner particles from the clouds surrounding the wires to the latent image recorded on the photoconductive surface of the belt. At a spacing ranging from about 10 microns to about 40 microns between the electrode wires and donor rolls, an applied voltage of 200 to 500 volts produces a relatively large electrostatic field without risk of air breakdown.

As successive electrostatic latent images are developed, the toner particles within the developer material 66 are depleted. A toner dispenser (not shown) stores a supply of toner particles. The toner dispenser is in communication with reservoir 64 and, as the concentration of toner particles in the developer material is decreased, fresh toner particles are furnished to the developer material in the reservoir. The auger 68 in the reservoir chamber mixes the fresh toner particles with the remaining developer material so that the resultant developer material therein is substantially uniform with the concentration of toner particles being optimized. In this way, a substantially constant amount of toner particles is in the reservoir with the toner particles having a constant charge.

The use of more than one development zone, for example, the two development zones 82, 84 as shown in FIG. 2, is desirable to ensure satisfactory development of a latent image, particularly at increased process speeds. If required, the development zones can have different characteristics, for example, through the application of a different electrical bias to each of the donor rolls. Thus, the characteristics of one zone may be selected with a view to achieving optimum line development, with the transfer characteristics of the other zone being selected to achieve optimum development of solid areas.

The apparatus shown in FIG. 2 combines the advantage of two development nips with the well established advantage offered by use of magnetic brush technology with two-component developer namely high volume reliability. With only a single magnetic brush roll 70, enabling a significant reduction in cost and a significant saving in space to be achieved compared with apparatus in which there is a respective magnetic brush roll for each donor roll. If more than two donor rolls are used then, depending on the layout of the system, it may be possible for a single magnetic brush roll to supply toner to more than two donor rolls.

In the arrangement shown in FIG. 2, the donor rolls 76, 78 and the magnetic brush roll 70 can be rotated either "with" or "against" the direction of motion of the belt 10. The two-component developer 66 used in the apparatus of FIG. 2 may be of any suitable type. However, the use of an electrically-conductive developer is preferred because it eliminates the possibility of charge build-up within the developer material on the magnetic brush roll which, in turn, could adversely affect development at the second donor roll. By way of example, the carrier granules of the developer material may include a ferromagnetic core having a thin layer of magnetite coated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

Ghosting, also known as reload, is a defect inherent to donor roll development technologies. It occurs both for single-component as well as hybrid systems, in which the toner layer on the donor roll is loaded by a magnetic brush. Generally, when an image is developed to a photoreceptor a negative of the image is left on the donor roll. This negative of the image, or ghost, persists to some extent even after it passes through the donor loading nip. Depending on the exact conditions of the loading nip, the ghost can persist as a mass difference, a tribo difference, a toner size difference, or a combination of these to give a toner layer voltage difference. Even subtle differences in these quantities can lead to differential development as the reloaded ghost image develops to the photoreceptor during its next rotation. A stress image pattern to quantify ghosting would be a solid area followed by a mid-density fine halftone at the position in the print corresponding to one donor roll revolution after the solid. Attempts to minimize the ghosting defect have focused on improving the donor loading so that the differences in toner layer properties between a ghost image and its surroundings are minimized after the reload step. While successful to some degree, ghosting is a problem that still limits system latitude in all donor roll development technologies.

Donor roll development systems produce an image ghost at a position on the print corresponding to one donor roll revolution after the image. The ghost image for a donor roll occurs at a position G1 after the original image on the photoreceptor. The position may be described as:

$$G1 = U_{pr} * 2\pi r / U_d$$

where $U_{pr}$ is the speed of the photoreceptor, r is the radius of the donor roll, and $U_{d1}$ is the surface speed of the donor roll. This relation holds for either direction of rotation of the donor roll. The image content at this position may be evaluated to determine whether it has the potential to generate a reload defect. Methods for determining the potential to generate a reload defect are set forth in a co-pending patent application that is commonly owned by the assignee of this application, having U.S. Ser. No. 10/998,098 that is entitled "Method Of Detecting Pages Subject To Reload Defect," the entire disclosure of which is hereby expressly incorporated in its entirety in this application by reference.

A reload defect detector may scan a reduced resolution image looking for locations where there is more than the minimum source level. A source area is a location on an image where toner may be removed from a donor in an amount sufficient to cause reload defect at a later point in the image. The minimum source level is the minimum amount of toner coverage that may later cause reload defect. A destination area is also evaluated. The destination area is a location at the appropriate number of scan lines after the source and, typically, corresponds to a location that is one donor revolution from the source position. The destination area is evaluated to determine whether the toner coverage at the destination area is greater than a minimum destination level. That is, the reload detector evaluates source areas and destination areas that are approximately one donor roll distance from one another to determine whether the source area "robs" sufficient toner from the donor roll to produce a ghost of the source area at the destination area. Locations meeting that criterion are then checked for high spatial frequency content (for example, by using a simple edge detection filter), and, if they lack high spatial frequencies, they may then be checked for neighbors that have also passed these tests. The neighboring pixels may be checked to see whether they tentatively cause reload defects by building a Boolean map of the test results, where a location in the map is true if the corresponding pixel has been evaluated to have reload defect potential. The logical AND of all the locations in a neighborhood may be used to combine the neighboring results. Other implementations are possible. Where enough neighbors are found, the pixel is considered to have reload potential, and that color separation component of the image is flagged as having reload potential.

A reload defect detector may use a reduced resolution image, where the resolution is selected so that the minimum feature width corresponds to approximately three pixels wide. Alternatively, the image evaluated may be a higher resolution image, including a full resolution image, in which case the neighborhoods used in the various tests would be correspondingly larger. A reload defect detector may also evaluate only a portion of an image. For example, if a document is printing on a template, only the variable data portion need be examined since the template portion of the document is the same for each page. In this scenario, a reduced amount of data would be retained for the template portion to indicate those portions of the template that may cause reload in the variable portion, and which portions might exhibit reload caused by the variable portion of the document. At a later time (i.e., page assembly time), the variable portion would be checked to determine whether it would produce reload in the previously examined template portion, or exhibit reload due to the data found in the previously examined template portion.

Many commercially available digital front end (DFE) processors for electrophotographic machines have the ability to generate low resolution images that may be used for reload defect evaluation. In particular, ⅛th resolution "thumbnail" images of the pages as they are raster scanned are produced for other applications and may be used for reload defect evaluation. A reload artifact detector may read those images and generate signals to transmit to the control software. In one embodiment, the DFE software may include the operation of computing a thumbnail image at some convenient size, for example one-eighth the original resolution, and then the DFE software, or an additional software component, reads the thumbnail image and evaluates the image for reload defect.

Figure 3:
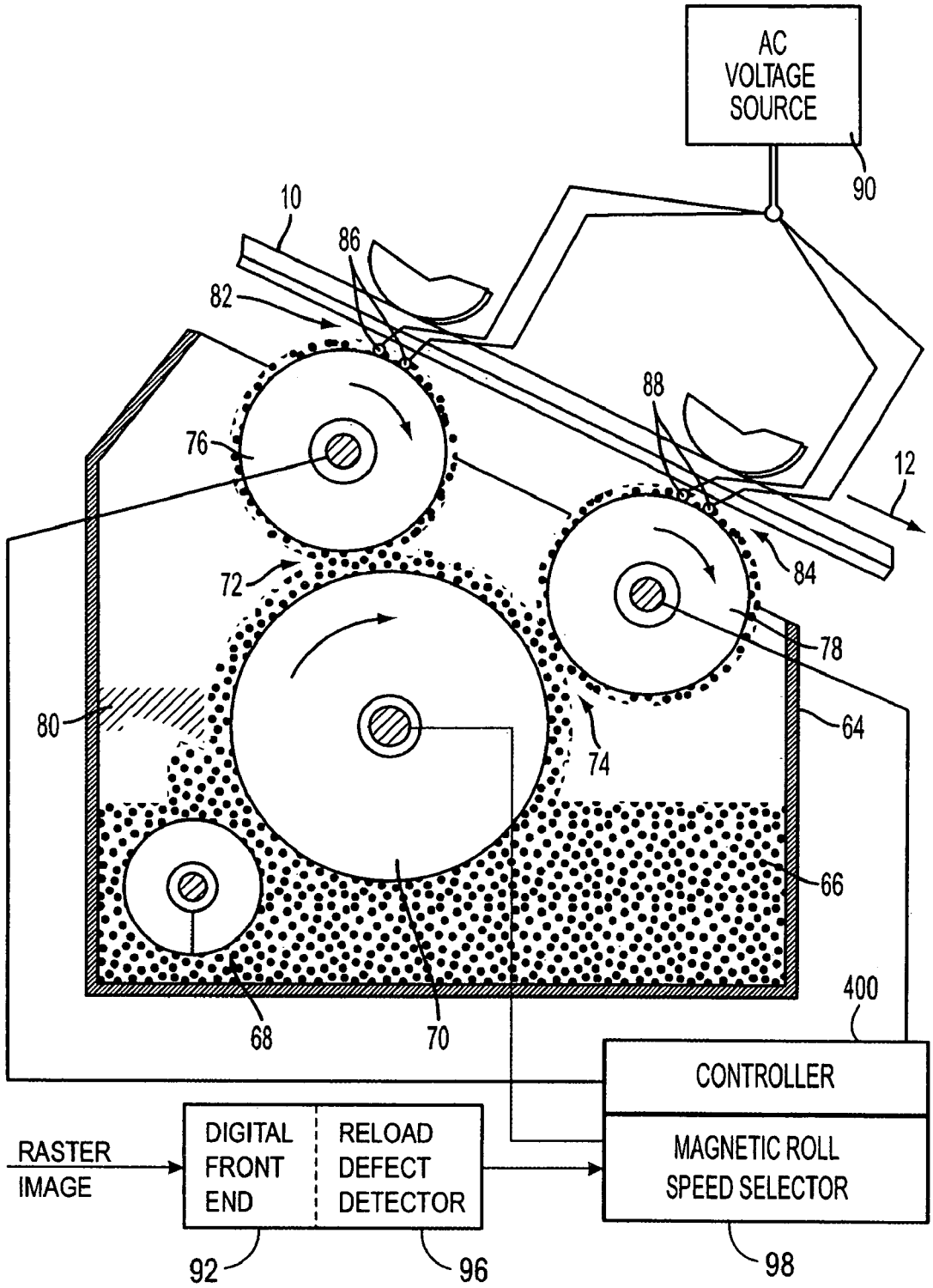
FIG. 3 is a schematic elevational view of the development apparatus shown in FIG. 2 with a block diagram of a system for reducing toner abuse.

An improved development system for an electrophotographic system is shown in FIG. 3. The development system is substantially the same as the one shown in FIG. 2. The digital front end processor (DFE) 92 of the electrophotographic machine shown in FIG. 1 includes a reload defect detector 96 for generating a signal corresponding to a potential for reload defect detected in an image to be developed by an electrophotographic system. The DFE 92 receives a reduced or full size raster scanned image for evaluation. The DFE 92 may include one or more software modules to implement the reload defect detector 96. Alternatively, the reload defect detector 96 may be included in the software library for the development controller 400 or it may be implemented in its own application specific integrated circuit (ASIC) as a stand alone component interposed between the magnetic roll speed selector 98 and the DFE 92. The reload defect detector 96 operates to compare the size and coverage of source and destination areas approximately one donor roll distance apart to determine whether a reload defect is possible. In an electrophotographic system having two donor rolls, the reload defect detector evaluates source and destination areas of the scan image at a donor roll distance corresponding to each donor roll. The donor roll distances vary from one another because of variations in the rotational speeds of the two donor rolls. The reload defect detector 96 generates a signal to the magnetic roll speed selector 98 that indicates whether or not a reload defect is likely to occur on a page corresponding to a latent image to be developed by the development system. In a two donor roll system, the reload defect detector 96 generates a signal indicating a reload defect is likely in response to either donor roll evaluation indicating a reload defect is likely. Alternatively, the signal may be one that indicates a probability that a reload defect will occur. The probability may reflect the likelihood that a reload defect, though produced by the electrophotographic system, may not be visible to a user. For example, if the image causing a reload defect is rendered with a light tint or has little spatial extent, the amount of toner involved may be so small that the defect is not visible.

The magnetic roll speed selector 98 selects a rotational speed for a magnetic roll in the improved development system. The magnetic roll speed selector 98 may be implemented with one or more software modules in the controller 400. Alternatively, the magnetic roll speed selector may be comprised of software components or hardware components of the DFE 92 or it may be implemented in its own application specific integrated circuit (ASIC) as a stand alone component interposed between the reload defect detector 96 and the DFE 92. In response to the signal from the reload defect detector 96, the magnetic speed selector adjusts the speed signal to the magnetic roll 70. In the embodiment in which the potential reload defect signal indicates a probability, the rotational speed may be selected from a range of possible magnetic roll speeds.

The signal generated by the reload defect detector 96 may take a variety of forms. For example, the reload defect detector may generate an analog signal indicative of a reload defect potential in the image to be developed by the electrophotographic system. The peak to peak value of the signal or its frequency may indicate the potential that a reload defect will occur from developing an image. Alternatively, the reload defect detector may generate a digital signal that indicates a reload defect potential in the image to be developed by the electrophotographic system. The digital signal may be a binary signal or a digital value that is indicative of a probability for the detected reload defect. The binary signal indicates whether a reload defect is likely to occur or not. The digital value is a multi-bit data word that may be used to quantify the potential for the detected reload defect. The greater the digital value, the higher the speed at which the magnetic roll is driven.

The magnetic roll speed selector 98 is coupled to the reload defect detector 96 and generates a signal in response to the reload defect potential signal received from the reload defect detector. When the reload defect potential signal is an analog signal, the magnetic roll speed selector 98 compares the analog signal to a reference threshold voltage or frequency to determine the potential for a reload defect. When the reload defect potential signal is a digital signal, the speed selector determines the state of the signal, if it is a binary signal, or the value of the signal, if it is a digital value.

The magnetic roll speed selector 98 may generate a current signal corresponding to a rotational speed magnitude. This current signal may be provided to the motor drive for the magnetic roll 70. The greater the magnitude of the current, the higher the speed at which the magnetic roll is driven. The magnetic roll speed selector may alternatively generate an analog signal, the voltage of which corresponds to a rotational speed magnitude. That is, the peak to peak voltage for the generated signal may be a control signal for the magnetic roll driver.

The magnetic roll speed selector may generate a digital signal corresponding to a rotational speed magnitude for the magnetic roll. The digital signal may be a binary signal or a digital value. When the digital signal is a binary signal, the state of the signal determines whether the magnetic roll is driven at a high speed or a low speed. In one embodiment, the low speed for the magnetic roll is 317 mm/second and the high speed is 1268 mm/second, although other speeds may be selected. Preferably, the low speed, which is selected in response to the reload defect not being likely, is approximately 25% of the high speed that is used to attenuate or prevent reload defect.

Figure 4:
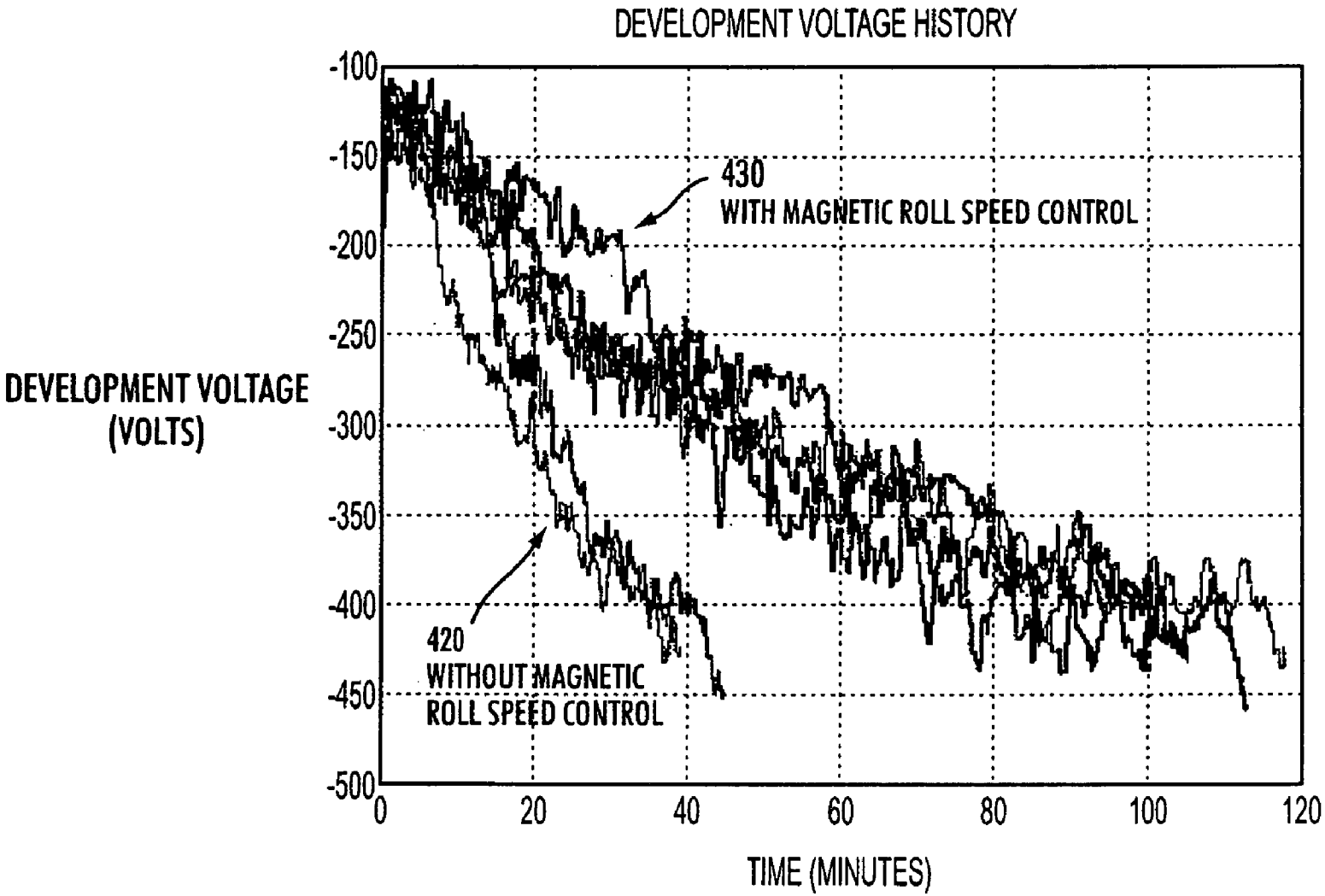
FIG. 4 is a graph showing the difference in the operational life of a development system with and without the system shown in FIG. 3.

When the magnetic roll of a development system is operated at a low speed that is approximately 25% of the high speed used to counteract reload defect, the operational life of the development system before corrective action is required is extended considerably. For example, a graph showing the increase in the development voltage over time as the electrophotographic system is used is depicted in FIG. 4. The data points in the graph line 420 depict a development system having its magnetic roll operated at the high rate of speed at all times to address reload defects that occur on an occasional basis. The development voltage in this system reaches its maximum of approximately −400V within about 40 minutes. The data points in the graph line 430 depict a development system having its magnetic roll operated at varying rates of speed in accordance with the detection of reload defect potential. When the magnetic roll is driven at a lower speed that is approximately 25% of the reload defect speed in response to a signal indicating a reload defect will occur, approximately 110 minutes are required before the maximum voltage is reached. Thus, the graph demonstrates that the operational life of a development system that controls the speed of the magnetic roll in accordance with the detection of reload defect potential is significantly extended over a development system that operates at a higher rate of speed at all times.

A magnetic roll speed selector 98 that generates a digital value may generate a value that corresponds to a magnetic roll speed in a predetermined range of magnetic roll speed. In this embodiment, the speed signal may be used to adjust the speed of the magnetic roll in a way that accounts for the size of the reload defect, the spatial frequency of the area in which the reload defect may occur, or the like. That is, the speed of the magnetic roll may be controlled to be sufficient to address the reload defect that is determined likely to occur and not the worst case scenario anticipated by the high magnetic roll speed. This worst case scenario is sometimes described as a solid area followed by a midlevel halftone separated from the original solid area by the equivalent of one donor roll revolution.

The magnetic roll speed selector may also include an input for a development voltage, a comparator for comparing the development voltage and a reference signal, and the magnetic roll speed selector generates a continuous high speed signal in response to the development voltage being equal to or greater than the reference signal. The reference signal corresponds to the maximum development voltage for the development system. Thus, when the development voltage is equal to or exceeds the maximum development voltage, the magnetic roll is continuously driven at the high speed used to counteract reload defect.

Figure 5:
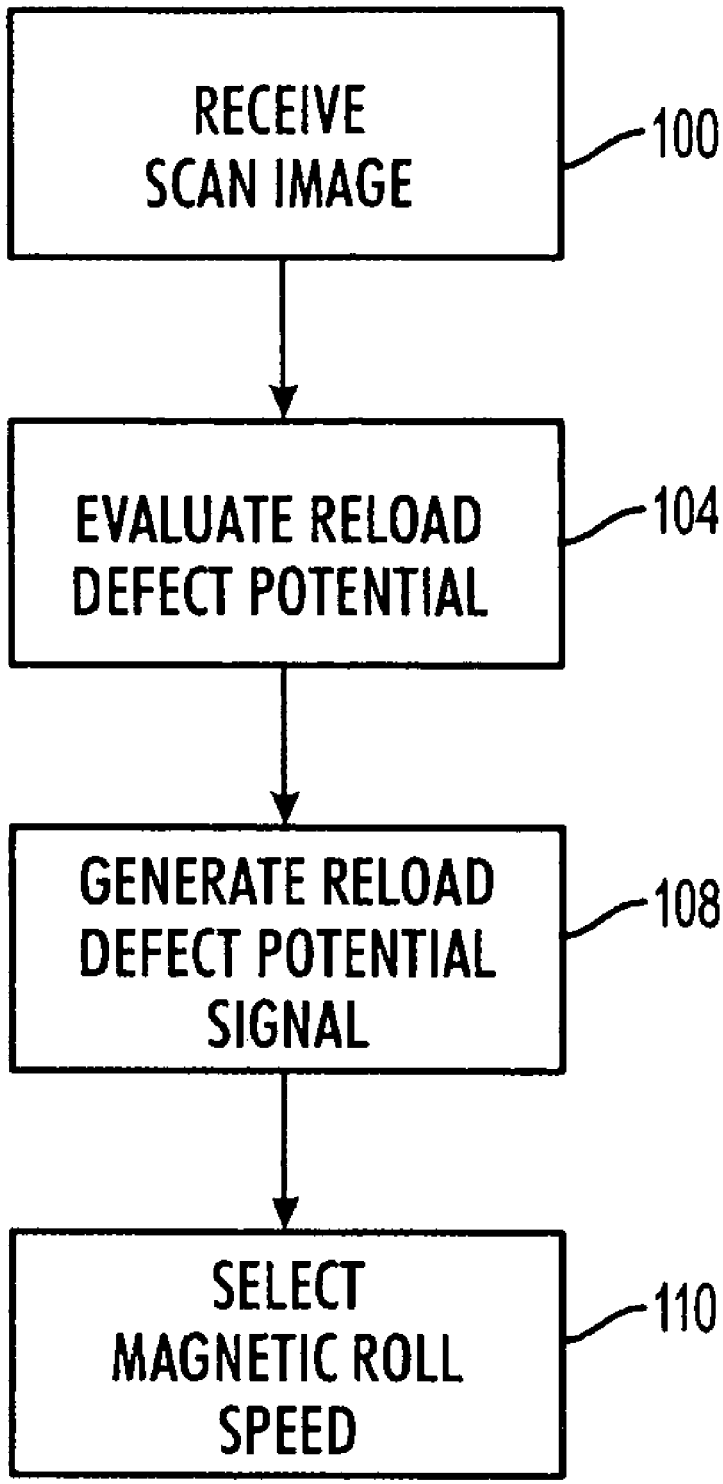
FIG. 5 is a flow diagram of a method for operating a development system in a manner that reduces toner abuse.

An improved method for operating a development system in an electrophotographic system is shown in FIG. 5. The method includes receiving a scan image (block 100), evaluating the likelihood of a reload defect occurring in the development of the image (block 104), generating a signal corresponding to a potential for reload defect detected in the scan image (block 108), and selecting a rotational speed for a magnetic roll in a development system of the electrophotographic system (block 110). The selected rotational speed corresponds to the reload defect potential signal.

The method may select a rotational speed by generating a signal indicative of a reload defect potential in the image to be developed. The generated potential reload defect signal may be an analog signal, the peak to peak voltage or frequency of which may be used to drive the magnetic roll speed. The method may alternatively select a magnetic roll speed by generating a digital signal. The digital signal may be a binary signal or a digital value. Each state of the binary signal corresponds to a predetermined speed for the magnetic roll. A digital value may be used to select a magnetic roll speed from a range of predetermined speeds for the magnetic roll.

Figure 6:
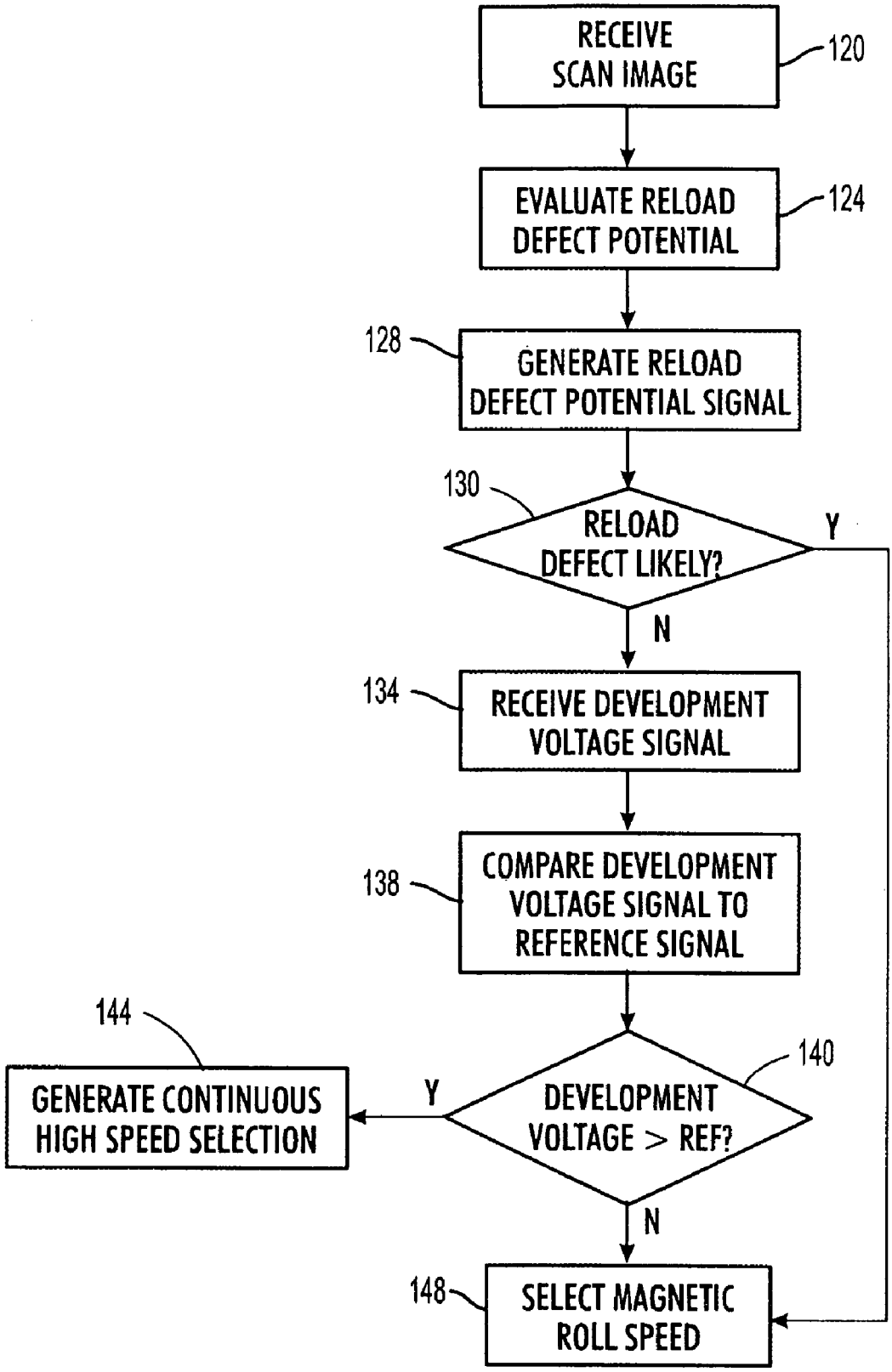
FIG. 6 is a flow diagram of a method for operating a development system in a manner that reduces toner abuse that enables continuous use of the system after the maximum development voltage has been reached.

Another method for operating the development system in response to detection of reload defects in an image to be developed is shown in FIG. 6. The method begins by receiving an scan image (block 120) and evaluating the likelihood of a reload defect occurring in the development of the image (block 124). A signal is generated that corresponds to a potential for reload defect detected in the scan image (block 128). If no reload defect is likely (block 130), the development voltage is read (block 134) and compared to a reference signal (block 138). If the development voltage is equal to or greater than the reference signal (block 140), a continuous high speed signal is generated for driving the magnetic roll (block 144). If the development voltage is less than the maximum development voltage, a rotational speed is selected for the magnetic roll that corresponds to the potential reload defect signal (block 148). If reload defect is likely, an appropriate magnetic roll speed is selected.

In operation, a DFE of an electrophotographic system may be modified to include a reload defect detector that generates a signal indicative of the potential for reload defect during the development of an image. The DFE or the development system controller may be modified to include a magnetic roll speed selector. The electrophotographic system may use one or more donor rolls. The system that adjusts magnetic roll speed to reduce toner abuse may be used in a hybrid scavengeless development system or a direct magnetic brush development system. As the electrophotographic system is operated, the reload defect detector determines the potential reload defect in an image to be produced by the system. If the potential indicates a reload defect is likely during the development of the image, the magnetic roll speed that best counteracts reload defect is selected. If the potential indicates a defect is not likely, a slower magnetic roll speed is selected to preserve the life of the toner. If the magnetic roll speed selector receives a signal corresponding to a development voltage, the speed selection process continues until the development voltage receives its maximum. Then, the magnetic roll is continuously operated at the speed that best counteracts reload defect until corrective action takes place.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An improved development system for an electrophotographic system comprising:

a reload defect detector for generating a signal corresponding to a potential for reload defect detected in a scanned image to be developed by an electrophotographic system; and a magnetic roll speed selector for selecting a rotational speed for a magnetic roll in a development system of the electrophotographic system, the magnetic roll speed selector being coupled to the reload defect detector to receive the signal generated by the reload defect detector and selecting a rotational speed for the magnetic roll in response to the generated reload defect potential signal.

2. The development system of claim 1, the reload defect detector further comprising:

a reload defect evaluator for comparing a source area to a destination area in the scanned image to determine the potential for a reload defect during the development of the scanned image.

3. The development system of claim 2, wherein the reload defect detector is coupled to the digital front end processor (DFE) of the electrophotographic system; and the reload defect evaluator receives a reduced scanned image from the DFE for reload defect evaluation of the image.

4. The development system of claim 3, the reload defect detector generating a digital signal having a value that is indicative of a probability for the detected reload defect.

5. The development system of claim 1, further comprising:

a motor drive for a magnetic roll in the electrophotographic system; and a magnetic roll coupled to the motor drive, the magnetic roll speed selector being coupled to the motor drive so that the signal generated by the magnetic roll speed selector determines the speed of the magnetic roll in response to the signal received from the reload defect detector.

6. The development system of claim 5, the magnetic roll speed selector generating a current signal for the motor drive that corresponds to a rotational speed magnitude.

7. The development system of claim 1, the magnetic roll speed selector further comprising:

an input for a development voltage;

a comparator for comparing the development voltage and a reference signal; and the magnetic roll speed selector generating a continuous high speed signal in response to the development voltage being equal to or greater than the reference signal.

8. A method for reducing toner abuse in an electrophotographic machine comprising:

receiving a scan image;

evaluating the likelihood of a reload defect occurring in the development of the scan image;

generating a signal corresponding to a potential for reload defect detected in the scan image; and selecting a rotational speed for a magnetic roll in a development system of the electrophotographic machine.

9. The method of claim 8, the reload defect evaluation comprising:

comparing a source area of the scan image to a destination area of the scan image to determine the potential for a reload defect.

10. The method of claim 8, the scan image reception including:

receiving a reduced image from a digital front end processor of the electrophotographic machine.

11. The method of claim 8, the magnetic roll speed selection including:

generating a signal corresponding to a rotational speed magnitude.

12. The method of claim 8, the magnetic roll speed selection further comprising:

receiving a signal corresponding to a development voltage;

comparing the development voltage signal and a reference signal; and generating a continuous high speed signal in response to the development voltage being equal to or greater than the reference signal.

13. An electrophotographic machine comprising:

a photoreceptor onto which a latent image is generated;

a magnetic roll for transporting toner from a toner supply;

a donor roll for transferring toner from the magnetic roll to the latent image on the photoreceptor;

a motor drive coupled to the magnetic roll for driving the magnetic roll;

a reload defect detector for receiving a scan image corresponding to the latent image on the photoreceptor and generating a signal indicative of a potential for reload defect during transfer of the toner to the latent image on the photoreceptor; and a magnetic roll speed selector coupled to the motor drive and to the reload defect detector, the magnetic roll speed selector selecting a magnetic roll speed in response to the signal generated by the reload defect detector and the motor drive driving the magnetic roll at the speed corresponding to the magnetic roll speed selected by the magnetic roll speed selector.

14. The machine of claim 13 further comprising:

a digital front end processor (DFE) for providing scan images to the reload defect detector.

15. The machine of claim 14 wherein the DFE provides reduced images to the reload defect detector.

16. The machine of claim 14, the reload defect detector including:

a reload defect evaluator for comparing a source area of the scan image received from the DFE to a destination area in the scan image to determine the signal to generate for indicating the potential for reload defect.

17. The machine of claim 16 further comprising:

a second donor roll for transferring toner from the magnetic roll to the latent image on the photoreceptor; and the reload defect detector evaluates the potential for defects at source and destination areas corresponding to both donor rolls.

18. The machine of claim 17 further comprising:

a pair of electrode wires located in proximity to each donor roll; and an alternating current source for providing an alternating current through the electrode wires associated with each donor roll to generate a toner cloud from the toner adhering to each donor roll.

19. The machine of claim 18, the magnetic roll speed selector further comprising:

an input for a development voltage;

a comparator for comparing the development voltage and a reference signal; and the magnetic roll speed selector generating a continuous high speed signal in response to the development voltage being equal to or greater than the reference signal.

20. The machine of claim 14 further comprising:

a pair of electrode wires located in proximity to the donor roll; and an alternating current source for providing an alternating current through the electrode wires to generate a toner cloud from the toner adhering to the donor roll.

* * * * *